United States Patent [19]

Nomura

[11] Patent Number: 5,033,351

[45] Date of Patent: Jul. 23, 1991

[54] FINGERBOARD AND NECK FOR ELECTRONIC MUSICAL INSTRUMENT

[75] Inventor: Yoshio Nomura, Oome, Japan

[73] Assignee: Casio Computer Co., Ltd., Tokyo, Japan

[21] Appl. No.: 338,725

[22] Filed: Apr. 14, 1989

[30] Foreign Application Priority Data

Apr. 25, 1988 [JP] Japan ..... 63-54540[U]
Apr. 25, 1988 [JP] Japan ..... 63-54541[U]

[51] Int. Cl.[5] ..... G10H 1/34

[52] U.S. Cl. ..... 84/646; 84/722; 84/744; 84/745

[58] Field of Search ..... 84/646, 720, 722, 744, 84/743, 745, 267, 293, 314 R, 315, DIG. 7, DIG. 30; 200/5 A

[56] References Cited

U.S. PATENT DOCUMENTS 3,624,583 11/1971 Nakada ..... 84/DIG. 7 X
3,624,584 11/1971 Ohno ..... 84/DIG. 7
3,626,350 12/1971 Suzuki et al. ..... 338/68
3,776,087 12/1973 Ogi ..... 84/672
4,235,141 11/1980 Eventoff ..... 84/722 X
4,570,521 2/1986 Fox ..... 84/DIG. 30 X
4,580,479 4/1986 Bonanno ..... 84/646 X

FOREIGN PATENT DOCUMENTS 1407364 9/1975 United Kingdom .
2029073 3/1980 United Kingdom .

*Primary Examiner*—W. B. Perkey
*Attorney, Agent, or Firm*—Frishauf, Holtz, Goodman & Woodward

[57] ABSTRACT

A fingerboard and a neck for an electronic musical instrument according to the present invention are used for an electronic musical instrument, such as an electronic guitar, an electronic violin, and a guitar synthesizer. A flexible sheet made of a slippery material is formed on the upper surface of a fingerboard incorporating a plurality of pitch designating means so as to allow smooth and quick fingering. A plurality of frets are formed on the upper surface of the flexible sheet so as to partition the pitch designating means.

11 Claims, 3 Drawing Sheets

FINGERBOARD AND NECK FOR ELECTRONIC MUSICAL INSTRUMENT

BACKGROUND OF THE INVENTION

1. Field of the Invention

The present invention relates to a fingerboard and a neck suitably used for an electronic musical instrument, such as an electronic guitar, an electronic violin, and a guitar synthesizer, used in place of an acoustic stringed instrument and, more particularly, to a fingerboard and a neck having a large number of pitch designating portions for designating the pitches of musical sounds to be generated by a sound source of an electronic musical instrument in response to a fingering operation on the fingerboard.

2. Description of the Related Art

An electronic musical instrument of the above-described type has a fingerboard or a neck with a fingerboard. Some fingerboards have no strings put thereon. In an electronic musical instrument having no strings put on its fingerboard, strings on only the upper surface of an instrument body are picked, or push switches on the upper surface of the body are depressed so that a sound source generates musical sounds in accordance with picked strings or depressed switches.

An electronic musical instrument using a fingerboard and a neck of the present invention includes all the instruments used in place of an acoustic stringed instrument regardless of the presence/absence of strings or a place where strings are kept taut.

Recently, an electronic musical instrument of a type having a fingerboard in which a large number of pitch designating switches, a resistor, or the like for designating the pitches of musical sounds to be generated by a sound source of the electronic musical instrument is embedded has been developed. For example, U.S. Pat. Nos. 4,570,521, 4,580,479, 3,624,583, and 3,626,350 disclose electronic musical instruments each having pitch designating switches arranged in a large number of spaces formed in an elastic fingerboard. In addition, U.S. Pat. Nos. 4,235,141, 3,624,584, and 3,776,087 disclose electronic musical instruments each having a neck in which a conductive plate is arranged on a support member having an elongated resistor through an insulating plate having a large number of orifices. Moreover, the assignee of the present invention has recently proposed electronic musical instruments each having a neck, in which an elastic fingerboard having a large number of pitch designating movable contacts is provided on a support member having a large number of pitch designating stationary contacts, in U.S. patent application Ser. Nos. 069,612, 094,402, 171,883, 184,099, and 256,398.

According to the above-described conventional or proposed electronic musical instruments, however, a fingerboard on which fingering is performed is made of a frictional material, such as silicone rubber and fibrous cloth. For this reason, when a sliding performance (a fingertip is moved along the longitudinal direction of a fingerboard while the sound source of an electronic musical instrument generates a musical sound) or a pitch bend performance (in an electronic musical instrument with strings, a finger is pressed on the strings, which are vibrated to generate musical sounds, along the upper surface of a fingerboard in its widthwise direction, thereby changing the pitches of the generated musical sounds) is to be performed, smooth movement of a finger on the fingerboard may be interfered by the frictional force of the finger with respect to the fingerboard. As a result, the above-described special fingering performances cannot be smoothly and quickly performed.

SUMMARY OF THE INVENTION

The present invention has been made to solve the above-described technical problem of the conventional and proposed electronic musical instruments used in place of acoustic stringed instruments. It is, therefore, an object of the present invention to provide a fingerboard and a neck for an electrical musical instrument, which allow smooth and quick fingering.

It is another object of the present invention to provide a structure which facilitates the manufacture of a fingerboard and a neck for an electronic musical instrument which are made to achieve the above-described object and which can contribute to a reduction in thickness and weight of the fingerboard and the neck.

In order to achieve the above-described objects, according to the present invention, there is provided a fingerboard for an electronic musical instrument, comprising a plurality of pitch designating means for designating a pitch of a musical sound to be generated by a sound source of the electronic musical instrument, a belt-like fingerboard member in which the plurality of pitch designating means are embedded, and a flexible sheet constituted by a slippery material and integrated with the fingerboard member.

The above objects of the present invention can be also achieved by a fingerboard for an electronic musical instrument, comprising a circuit board having a stationary contact on an upper surface thereof, a flexible insulating member arranged above the circuit board, on a lower surface of which a movable contact is formed above the stationary contact with a predetermined gap set therebetween, and a sheet having a slippery surface and integrated with an upper surface of the flexible insulating member.

The above objects of the present invention can be also achieved by a fingerboard for an electronic musical instrument, comprising a plurality of pitch designating means for designating a pitch of a musical sound to be generated by a sound source of the electronic musical instrument, a belt-like fingerboard member in which the plurality of pitch designating means are embedded, a rigid fret member arranged on the fingerboard member and having a plurality of rigid frets extending in a direction substantially perpendicular to a longitudinal direction of the fingerboard member so as to be spaced apart from each other in the longitudinal direction of the fingerboard member, and a flexible sheet constituted by a slippery material and integrated with said rigid fret member between the rigid frets.

A neck of the present invention comprises a support member for supporting the fingerboard member of the fingerboard having various unique arrangements described above.

DETAILED DESCRIPTION OF THE PREFERRED EMBODIMENTS

Various embodiments of the present invention will be described in detail below with reference to the accompanying drawings.

Figure 1:
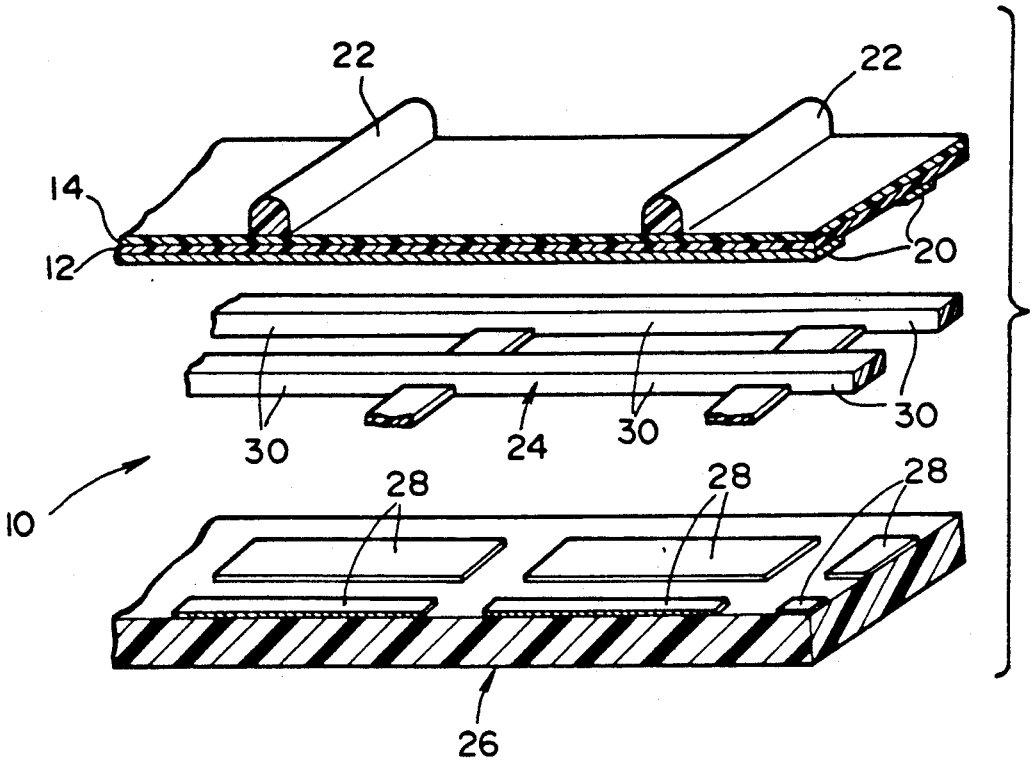
FIG. 1 is an exploded perspective view schematically showing a part of a fingerboard according to a first embodiment of the present invention with their longitudinal and cross sections.
Figure 2:
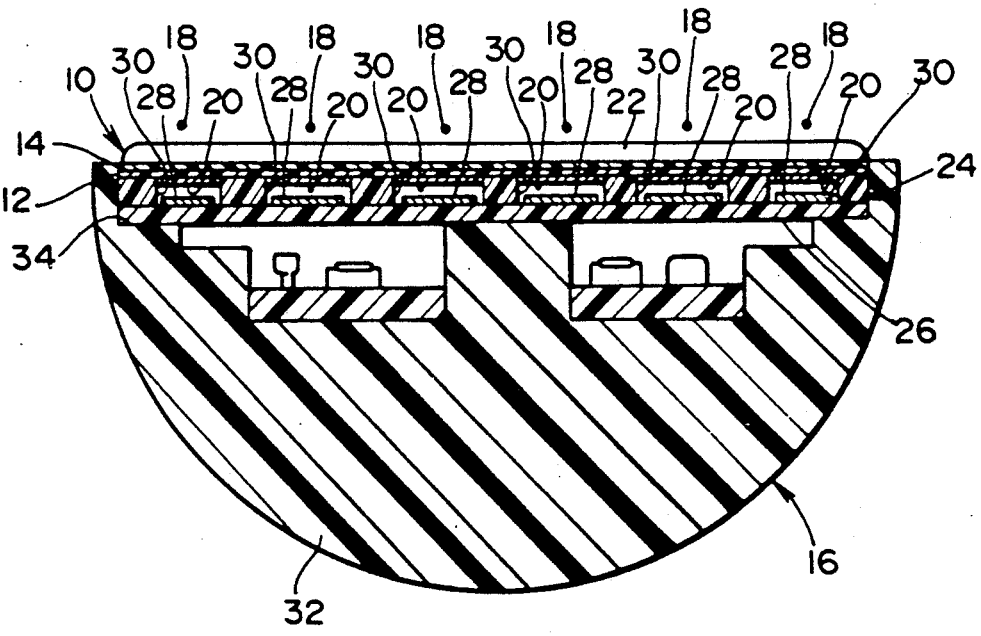
FIG. 2 is a cross-sectional view schematically showing a neck on which the fingerboard of the first embodiment is mounted.

FIGS. 1 and 2 schematically show a part of a fingerboard according to a first embodiment of the present invention, and a cross section of a neck including the fingerboard, respectively.

A fingerboard 10 comprises a belt-like fingerboard member 12 consisting of a flexible, insulating sheet, such as a polyester sheet, and a sheet 14 having a slippery surface, such as a polyester sheet, provided on the entire upper surface of the fingerboard member 12. A large number of movable contacts 20 are formed on the lower surface of the fingerboard member 12 at positions corresponding to a plurality of strings 18 kept taut above a neck 16, on the upper surface of which the fingerboard member 12 is provided, as shown in FIG. 2, so as to extend parallel to each other in the longitudinal direction of the neck 16. Frets 22 each having a slippery surface, such as polyester frets, are provided on the upper surface of the slippery sheet 14 at predetermined intervals in the longitudinal direction of the neck 16 so as to extend in its widthwise direction. The frets 22, the sheet 14, and the fingerboard member 12 are integrated with each other in a laminated state.

A spacer member 24 consisting of a polyester sheet is bonded to the lower surface of the fingerboard member 12 having the above-described arrangement. A wiring board 26 is bonded to the lower surface of the spacer member 24. A large number of stationary contacts 28 are formed on the upper surface of the wiring board 26 at positions corresponding to the movable contacts 20 on the lower surface of the fingerboard member 12. The movable contacts 20 on the lower surface of the fingerboard member 12 and the stationary contacts 28 on the wiring board 26 oppose each other through window holes 30 formed in the spacer member 24.

The wiring board 26 having the stationary contacts 28 constitutes a pitch designating means in the fingerboard 10 together with the movable contacts 20 opposing the wiring board 26 through the spacer member 24.

FIG. 2 shows a state wherein the fingerboard 10 shown in FIG. 1 is fitted in a storage portion 34 formed in the upper surface of a support member 32 of the neck 16.

According to the fingerboard 10 of this embodiment, since the slippery sheet 14 is provided on the entire upper surface of the fingerboard member 12, the upper surface of the fingerboard 10 has excellent slip properties. Therefore, a pitch designation operation can be performed while a finger is smoothly and quickly moved on the upper surface of the fingerboard 10 in its longitudinal direction during, e.g., a sliding performance. In addition, since the frets 22, the slippery sheet 14, and the fingerboard member 12 are integrated with each other in a laminated state, the fingerboard 10 can be easily manufactured and can be formed into a low-profile, lightweight fingerboard.

In this embodiment, the frets 22 and the slippery sheet 14 are independently formed. However, they may be integrally formed by using the same material.

Figure 3:
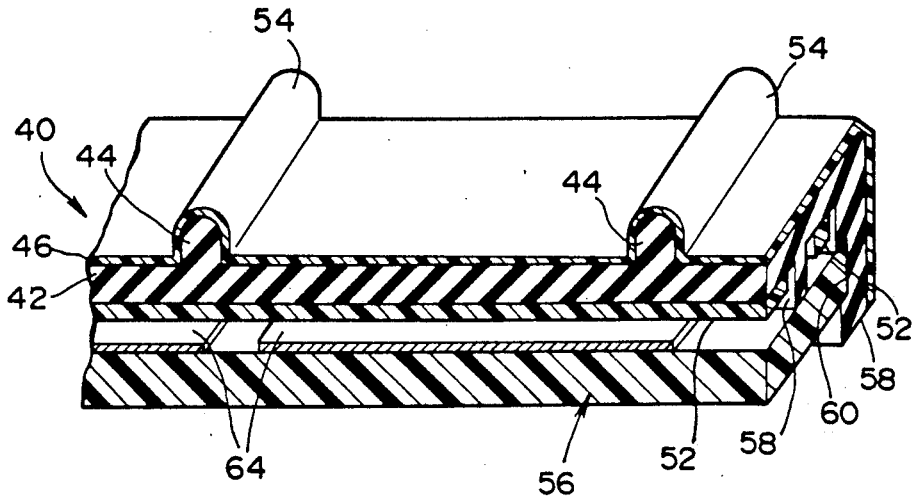
FIG. 3 is a perspective view schematically showing a part of a fingerboard according to a second embodiment of the present invention with its longitudinal and cross sections.
Figure 4:
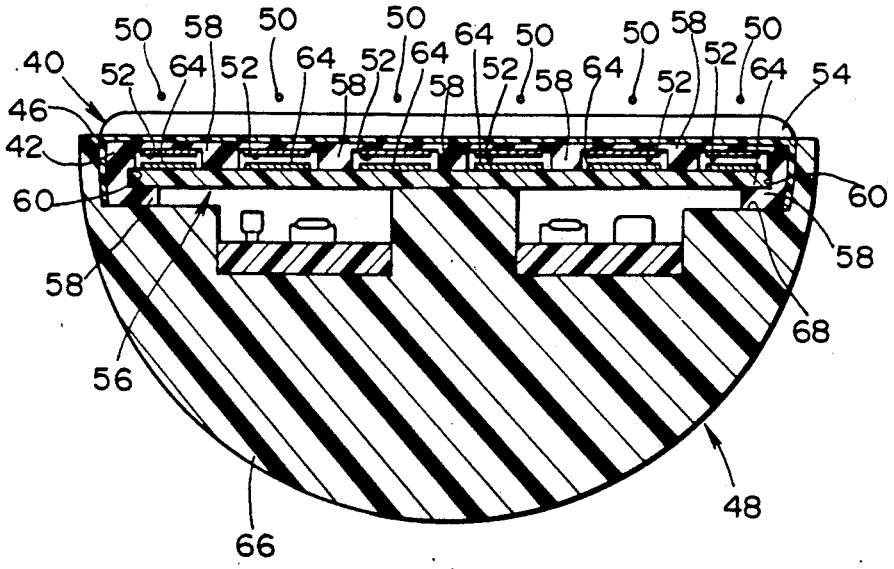
FIG. 4 is a cross-sectional view schematically showing a neck on which the fingerboard of the second embodiment is mounted.

FIGS. 3 and 4 respectively show a part of a fingerboard according to a second embodiment of the present invention and a cross section of a neck including the fingerboard.

A fingerboard 40 comprises a fingerboard member 42 consisting of a belt-like material having flexibility and insulating properties, such as silicone rubber. A predetermined number of fret positioning projections 44 are integrally formed with the fingerboard member 42 on its upper surface at predetermined intervals in its longitudinal direction so as to extend in its widthwise direction. The entire upper surface of the fingerboard member 42 is covered with a slippery sheet 46 consisting of a polyester sheet. The sheet 46 includes hollow frets 54 to be bonded to the projections 44 on the upper surface of the fingerboard member 42. The fingerboard member 42 has a substantially inverted U-shaped cross section. As shown in FIG. 4, a large number of movable contacts 52 consisting of conductive silicone rubber are integrated with the lower surface of the fingerboard member 42 in a laminated state at positions corresponding to a plurality of strings 50. The strings 50 are kept taut above a neck 48, on the upper surface of which the fingerboard member 42 is formed, so as to extend parallel to each other along the longitudinal direction of the neck 48. As shown in FIG. 3, the slippery sheet 46 and the fingerboard member 42 are laminated and integrated with each other while the hollow frets 54 are fitted on the fret positioning projections 44.

Note that the fingerboard member 42 need not include the fret positioning projections 44. If the projections 44 are not used, the frets 54 may be formed into solid frets.

A wiring board 56 is arranged in a recess of the lower surface of the fingerboard member 42. The wiring board 56 is fixed in the recess such that both the side edges of the wiring board 56 extending in its longitudinal direction are fitted in longitudinal grooves 60 serving as clamp portions respectively formed in the inner side surfaces of a pair of leg portions 58 formed along both the longitudinal side edges of the fingerboard member 42. A plurality of spacer members 62 are integrally formed on the bottom surface area of the recess of the lower surface of the fingerboard member 42 so as to project downward. The movable contacts 52 on the lower surface of the fingerboard member 42 and stationary contacts 64 printed on the upper surface of the wiring board 56 oppose each other between the spacer members 62.

In this case, the wiring board 56 having the stationary contacts 64 constitutes a pitch designating means in the fingerboard 40 together with the movable contacts 52 opposing the wiring board 56 through the spacer members 62.

FIG. 4 shows a state wherein the fingerboard 40 shown in FIG. 3 is fitted in a storage portion 68 formed in the upper surface of a support member 66 of the neck 48.

Similar to the fingerboard 10 of the first embodiment, in the fingerboard 40 of this embodiment, the slippery sheet 46 is provided on the entire upper surface of the fingerboard member 42 so that the upper surface of the fingerboard 40 has excellent slip properties. Therefore, a pitch designating operation can be performed by smoothly and quickly movement of a finger on the upper surface of the fingerboard 40 in its longitudinal direction during, e.g., a sliding performance.

In addition, since the sheet 46 and the fingerboard member 42 are integrated with each other in a laminated state, the fingerboard 40 can bé easily manufactured and can be formed into a low-profile, lightweight fingerboard.

The slippery sheet used in the present invention is not limited to the polyester sheet used in the first and second embodiments. For example, a polyimide sheet may be employed. In the first embodiment, the independently formed frets 22 are provided on the slippery sheet 14. However, the slippery sheet 14 and the frets 22 may be integrally formed with each other.

Figure 5:
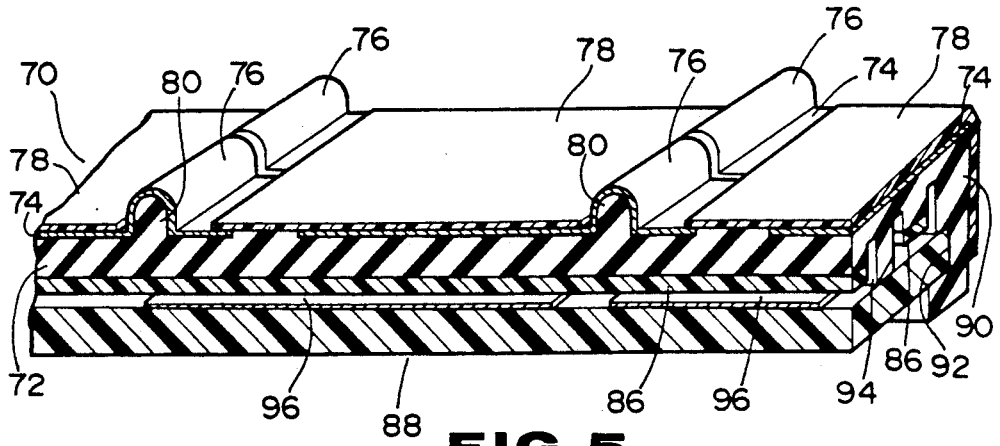
FIG. 5 is a perspective view schematically showing a part of a fingerboard according to a third embodiment of the present invention with its longitudinal and cross sections.
Figure 6:
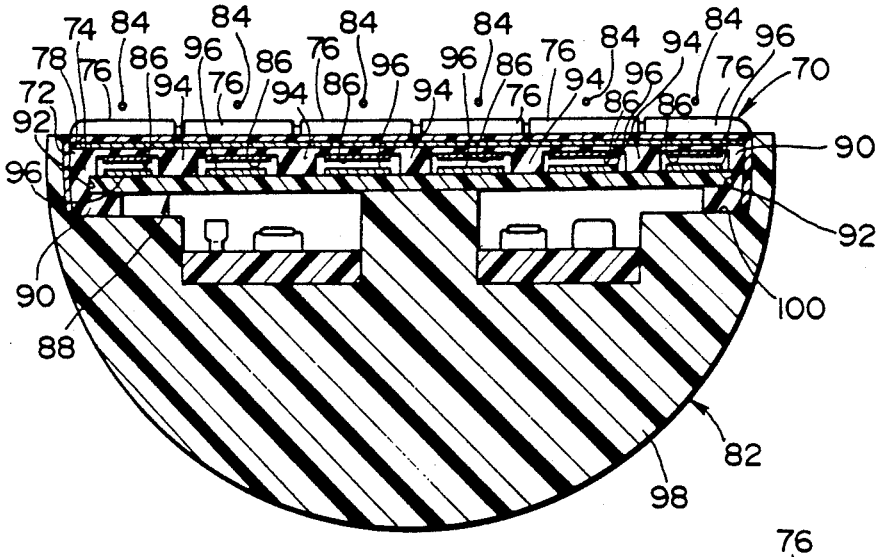
FIG. 6 is a cross-sectional view schematically showing a neck on which the fingerboard of the third embodiment is mounted.
Figure 7:
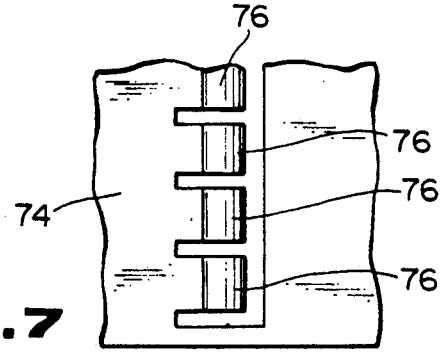
FIG. 7 is a plan view schematically showing a main part of a rigid sheet in the fingerboard of the third embodiment.

FIGS. 5 to 7 show a fingerboard according to a third embodiment of the present invention.

A fingerboard 70 comprises a belt-like fingerboard member 72, a plurality of rigid fret members 74 (on the upper surfaces of which rigid frets 76 are integrally formed to extend in the widthwise direction of the fingerboard member 72) arranged on the upper surface of the fingerboard member 72 at predetermined intervals in its longitudinal direction, and slippery sheets 78 provided on the rigid fret members 74 between the rigid frets 76.

The fingerboard member 72 consists of a silicone rubber member having flexibility and insulating properties, and has a substantially inverted U-shaped cross section. A predetermined number of fret positioning projections 80 are integrally formed on the upper surface of the fingerboard member 72 at predetermined positions spaced from each other in the longitudinal direction of the fingerboard member 72 sc as to extend in its widthwise direction. As shown in FIG. 6, movable contacts 86 consisting of conductive silicone rubber are integrated with the lower surface of the fingerboard member 72 in a laminated state at positions corresponding to a plurality of strings 84. The strings 54 are kept taut above a neck 82, on the upper surface of which the fingerboard member 72 is provided, so as to extend parallel to each other in its longitudinal direction.

Each rigid fret member 74 is formed of a metal or a hard synthetic resin. The rigid fret members 74 are arranged at predetermined positions on the upper surface of the fingerboard member 72 by respectively fitting the rigid frets 76 on the fret positioning projections 80 on the upper surface of the fingerboard member 72, as shown in FIG. 5. The rigid frets 76 are formed by press work or injection molding. As shown in FIGS. 6 and 7, in correspondence with the strings 84 kept taut above the neck 82, each fret 76 is divided into portions of the same number as that of the strings (six in this embodiment).

Each slippery sheet 78 consists of a polyester sheet. The sheets 78 cover the upper surfaces of the plurality of fret members 74 between the plurality of rigid frets 76, and also cover both the side surfaces of the fingerboard member 72. The fingerboard member 72, the rigid fret members 74, and the slippery sheets 78 are integrated with each other in a laminated state.

A wiring board 88 is arranged in a recess of the lower surface of the fingerboard member 72. The wiring board 88 is fixed in the recess such that both the side edges of the wiring board 88 extending in its longitudinal direction are fitted in longitudinal grooves 92 serving as clamp portions respectively formed in the inner surfaces of a pair of leg portions 90 formed along both the side edges of the fingerboard member 72 extending along its longitudinal direction.

A plurality of spacer members 94 are internally formed on the bottom surface area of the recess of the lower surface of the fingerboard member 72 so as to project downward. The movable contacts 86 on the lower surface of the fingerboard member 72 and stationary contacts 96 printed on the upper surface of the wiring board 88 oppose each other through the spacer members 94. In this case, the wiring board 88 having the stationary contacts 96 constitutes a pitch designating means in the fingerboard 70 together with the movable contacts 86 opposing the wiring board 88 through the spacer members 94.

FIG. 6 shows a state wherein the fingerboard 70 shown in FIG. 5 is fitted in a storage portion 100 formed in the supper surface of a support member 98 of a neck 82.

In the fingerboard 70 of this embodiment, since the slippery sheet 78 is provided on the entire upper surface of the fingerboard member 72, the upper surface of the fingerboard 70 has excellent slip properties. Therefore, a pitch designating operation can be performed by smoothly and quickly movement of a finger on the upper surface of the fingerboard 70 along its longitudinal direction during, e.g., a sliding performance.

In addition, since the frets on the supper surface of the fingerboard 70 are constituted by the rigid frets 76 of the rigid fret members 74, the wear resistance of the frets can be increased, thereby ensuring the fret function over a long period of time. Moreover, since the fingerboard member 72, the rigid sheet 74, and the slippery sheet 78 are integrated with each other in a laminated state, the fingerboard 70 can be easily manufactured and can be formed into a low-profile, lightweight fingerboard.

The slippery sheets 14, 46, and 78 used in the present invention are not limited to the polyester sheet used in the above-described embodiments. For example, a polyimide sheet may be employed. In addition, in the above-described embodiment, the fret positioning projections 80 are formed on the fingerboard member 72, and the hollow rigid frets 76 of the rigid fret members 74 are respectively fitted on the fret positioning projections 80. However, the fret positioning projections 80 of the fingerboard 72 may be omitted.

What is claimed is:

1. A fingerboard for an electronic musical instrument, comprising:

a plurality of pitch designating means for designating a pitch of a musical sound to be generated;

a belt-like fingerboard member to which said plurality of pitch designating means are connected;

a rigid fret member arranged on said fingerboard member and having a plurality of rigid frets extending in a direction substantially perpendicular to a longitudinal direction of said fingerboard member so as to be spaced apart from each other in the longitudinal direction of said fingerboard member; and a flexible sheet comprised of a slippery material and fitted on said rigid fret member between said plurality of rigid frets, and defining a slippery fingering surface on an outer side of said fingerboard member.

2. A fingerboard according to claim 1, wherein said rigid fret member comprised by a single metal plate.

3. A fingerboard according to claim 1, wherein each of said plurality of rigid frets comprises fret pieces formed independently of each other.

4. A neck for an electronic musical instrument, comprising:

a plurality of pitch designating means for designating a pitch of a musical sound to be generated;

a belt-like fingerboard member to which said plurality of pitch designating means are connected;

a rigid fret member arranged on said fingerboard member and having a plurality of rigid frets extending in a direction substantially perpendicular to a longitudinal direction of said fingerboard member so as to be spaced apart from each other in the longitudinal direction of said fingerboard member;

a flexible sheet comprised of a slippery material and fitted on said rigid fret member between said plurality of rigid frets, and defining a slippery fingering surface on an outer side of said fingerboard member; and a support member for supporting said fingerboard member.

5. A fingerboard for an electronic musical instrument, comprising:

a belt-like fingerboard member having an upper surface on which a plurality of fret-positioning projections are mounted, said fret positioning projections being spaced apart from each other in a longitudinal direction of the fingerboard member;

a plurality of pitch designating means, arranged under the fingerboard member and corresponding in location to the fret-positioning projections, for designating a pitch of a musical sound to be generated; and a flexible sheet formed of a slippery material, said flexible sheet fitted on the upper surface of the fingerboard member and on upper portions of the fret-positioning projections;

said flexible sheet defining a slippery fingering surface on an outer side of the fingerboard member.

6. A fingerboard for an electronic musical instrument, comprising:

a belt-like circuit board;

a plurality of stationary contacts mounted on the belt-like circuit board, said stationary contacts being spaced apart from each other in a longitudinal direction of the belt-like circuit board;

a belt-like flexible insulating member mounted on the belt-like circuit board and extending in the longitudinal direction of the circuit board;

a plurality of movable contacts mounted to a lower surface portion of the belt-like flexible insulating member, with a predetermined space defined above the plurality of stationary contacts; and a slippery flexible sheet fitted on an upper surface of the flexible insulating member and having a plurality of frets which are located in correspondence to the plurality of movable contacts, said flexible sheet defining a slippery fingering surface on an outer side of the fingerboard.

7. A fingerboard according to claim 6, further comprising a spacer member mounted between the belt-like flexible insulating member and the belt-like circuit board.

8. A fingerboard according to claim 7, wherein said belt-like flexible insulating member and said spacer member are integral with each other.

9. A fingerboard according to claim 7, wherein said belt-like flexible insulating member and said spacer member are formed independently of each other.

10. A fingerboard according to claim 6, wherein said frets are formed of slippery synthetic resin.

11. A fingerboard for an electronic musical instrument, comprising:

a belt-like circuit board having an upper surface on which a plurality of stationary contacts are mounted, said stationary contacts being spaced apart from each other in a longitudinal direction of the belt-like circuit board;

a flexible insulating member having a plurality of movable contacts which are mounted on the belt-like circuit board along the longitudinal direction of the belt-like circuit board, said movable contacts being located above the stationary contacts with a predetermined space therebetween;

a belt-like fingerboard member having a plurality of fret-positioning projections formed thereon, said fret-positioning projections being spaced apart from each other in the longitudinal direction of the belt-like circuit board; and a slippery flexible sheet formed of a slippery material, said slippery flexible sheet fitted on an upper surface of the fingerboard member and on upper portions of the fret-positioning projections, said slippery flexible sheet defining a slippery fingering surface on an outer side of the fingerboard member.

* * * * *